US006583345B1

(12) United States Patent
Clinton

(10) Patent No.: US 6,583,345 B1
(45) Date of Patent: Jun. 24, 2003

(54) WALKING CANE STRINGED INSTRUMENT

(76) Inventor: Roderick Paul Clinton, P.O. Box 6863, Santa Barbara, CA (US) 93160

( * ) Notice: Subject to any disclaimer, the term of this patent is extended or adjusted under 35 U.S.C. 154(b) by 0 days.

(21) Appl. No.: 10/090,660

(22) Filed: Mar. 4, 2002

(51) Int. Cl.[7] ..... G10D 3/00
(52) U.S. Cl. ..... 84/291
(58) Field of Search ..... 84/291, 267; 65/67, 65/68, 69, 74, 73, 76, 80, 81

(56) References Cited

U.S. PATENT DOCUMENTS

| | | | | | |
|---|---|---|---|---|---|
| 4,236,711 | A | * | 12/1980 | Klingbeil | 472/72 |
| 4,646,613 | A | * | 3/1987 | Banchetti | 84/327 |
| 5,137,503 | A | * | 8/1992 | Yeh | 482/125 |
| D427,763 | S | * | 7/2000 | Kikuchi et al. | D3/7 |

* cited by examiner

*Primary Examiner*—Kim Lockett
(74) *Attorney, Agent, or Firm*—Michael G. Petit

(57) ABSTRACT

A versatile walking cane adapted to be used alternatively as a stringed musical instrument. The cane has a handle portion, a tip portion and an elongate, preferably cylindrical body portion therebetween. The body portion has a plurality of tuning pegs rotatably mounted thereon adjacent the handle portion, a nut rigidly mounted near the tip portion and a bridge rigidly mounted between the tuning pegs and the nut. One end of each of a plurality of strings are spaced from one another and attached to the nut while the opposing ends of the strings are attached to the tuning pegs such that the strings contact the bridge and the nut and are spaced from the portion of the body portion therebetween. The portion of the strings between the bridge and the nut overlie a plurality of frets rigidly attached to the portion of the body portion between the nut and the bridge. The body portion, which is preferably hollow, may further include a hole therein disposed between the bridge and the nut. A rubber cap is preferably affixed to the tip portion. The cane may be used either as a support for walking or as a musical instrument.

5 Claims, 2 Drawing Sheets

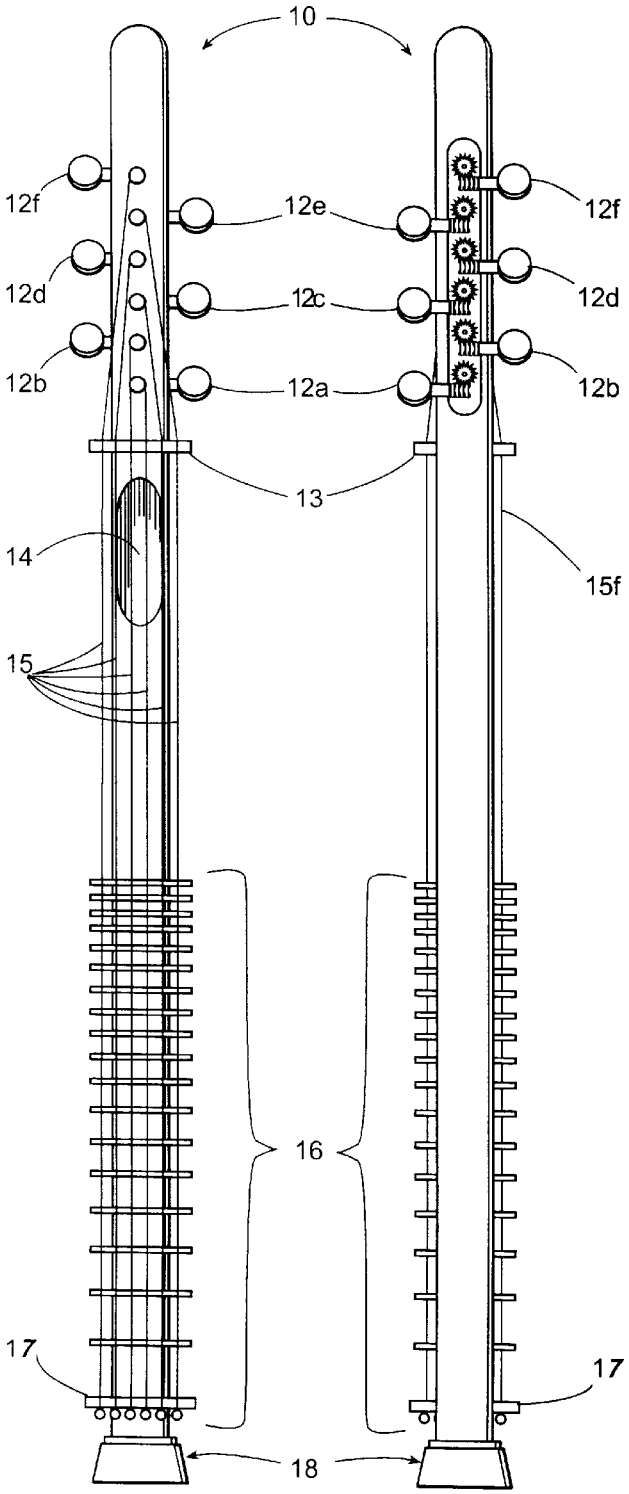
FIGURE 4
FIGURE 5
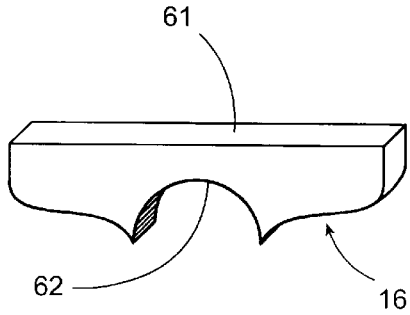
FIGURE 6
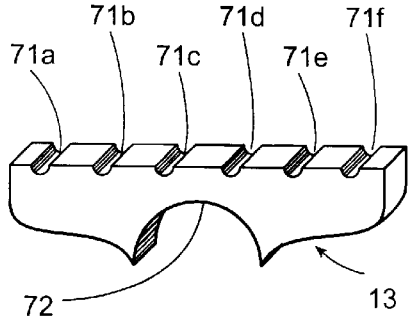
FIGURE 7

WALKING CANE STRINGED INSTRUMENT

BACKGROUND OF THE INVENTION

1. Field of the Invention

A cane operable in one aspect for supporting an ambulatory person and, in another aspect, as a musical instrument.

2. Prior Art

Canes for assisting a person to walk are well known in the art. Such canes generally comprise an elongate staff with a handle portion on one end of the staff and a tip at the opposing end. The staff may be solid or hollow, and made from a variety of materials. Metal tubes, such as tubular aluminum, are presently preferred materials used for forming a cane. While such canes have been modified to serve a purpose other than support, such as, for example, to be used as a weapon, the cane has not been adapted for use as a musical instrument.

Disabled people requiring the use of a cane in order to be ambulatory have one hand dedicated to holding onto the cane. The other hand must remain available for routine tasks such as opening doors and answering the telephone. Accordingly, it is difficult for such people to carry a musical instrument when they leave the home. It would be desirable to provide a walking cane that, when not being used for support, can be used for practicing or otherwise playing a musical instrument such as a guitar. Such a modified, multipurpose cane can be used, for example, for practicing guitar while sitting in a waiting room or waiting at a bus stop.

SUMMARY

It is an object of the present invention to provide a musical cane comprising, in combination: (a) a cane operable for providing support for a person and having a handle portion adapted to be gripped by the person's hand, a tip portion and a hollow, elongate body portion therebetween; and (b) a musical instrument affixed to said body portion.

It is a further object of the invention to provide a musical cane meeting the above objective wherein said musical instrument comprises a plurality of tuning pegs rotatably attached to said body portion, a nut rigidly attached to said body portion, a notched bridge either adjustably or rigidly mounted on said body portion between said tunable pegs and said nut, and a plurality of strings, each string having one end attached to said nut, and the opposing end of each string attached to a tuning peg comprising said plurality of tuning pegs. The musical cane preferably further comprises a hole in said hollow, elongate body portion disposed between said bridge and said nut and wherein said tip portion has a rubber cap attached thereto.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

BRIEF DESCRIPTION OF THE DRAWINGS

FIG. 4 is a front view of the first preferred embodiment of the present invention illustrated in FIGS. 1–3.

FIG. 5 is a rear view of the first preferred embodiment of the present invention illustrated in FIGS. 1–4.

FIG. 6 is a front perspective view of an individual exemplary fret comprising the plurality of frets mounted on the body portion.

FIG. 7 is a front perspective view of a bridge adapted for attachment to the body portion of a cane in accordance with the present invention.

DESCRIPTION OF THE PREFERRED EMBODIMENTS

Figure 1:
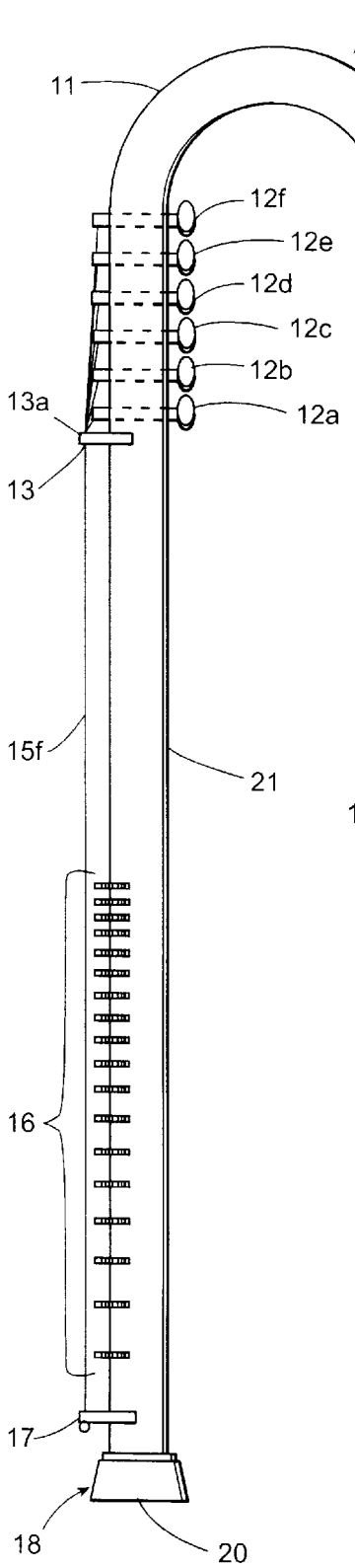
FIG. 1 is a left side view of a musical walking cane in accordance with a first preferred embodiment of the present invention.

With reference to FIG. 1, a musical walking cane in accordance with a first preferred embodiment of the present invention is illustrated at numeral 10 in left side view. The cane 10 has been modified to enable the cane to be used alternatively as a guitar. The cane 10 has a handle portion 11, a hollow, elongate, preferably cylindrical or tubular body portion 21 and a tip portion 18. A plurality of tuning pegs 12*a–f* are rotatably mounted on the body portion 21 adjacent to the handle portion 11. A nut 17 comprising means for attaching one end of a plurality of strings 15*a–f* (FIG. 2) in spaced relationship to one another is rigidly affixed to the body portion 21 adjacent the tip portion 18. A bridge 13 is rigidly affixed to the body portion 21 between the tuning pegs 12*a–f* and the nut 17. The bridge 13 has a notched outer surface 13*a* comprising 6 notches, each one of the notches being dimensioned to accommodate at least a portion of one of the plurality of strings 15*a–f* therewithin. A plurality of frets 16 are rigidly affixed to a portion of the body portion 21 between the bridge 13 and the nut 17 to underlie the strings 15*a–f*. An end cap 19 is affixed to the handle portion 11 to seal the interior chamber bounded by the wall of the handle and body portion of the tubular cane. A rubber foot 20 is affixed to the tip portion 18 to seal the opposing end of the interior chamber and provide traction on a supporting surface. The body portion 21 may further include an opening 14 (FIG. 4) into the tubular inner chamber of the cane that may be used to improve the tonal quality of the music derived from the cane 10.

Figure 2:
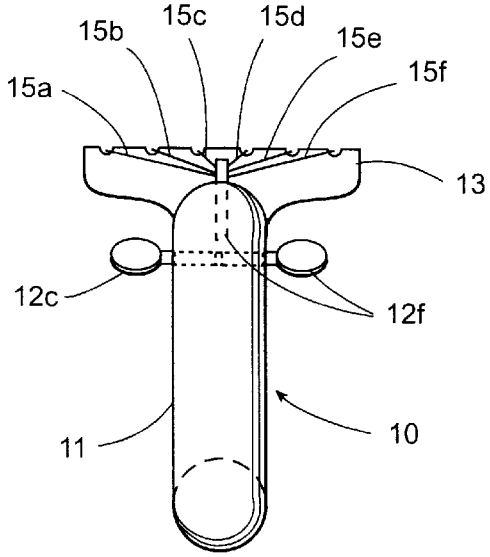
FIG. 2 is a top view of the first preferred embodiment of the present invention illustrated in FIG. 1.

FIG. 2 is a top view of the first preferred embodiment of the present invention illustrated in FIG. 1. The ends of each of the plurality of strings 15*a–f* in opposition to the end attached to the nut are attached to the tuning pegs 12*a–f*. The tuning pegs are operable for individually adjusting the tension in each of the strings 15*a–f*.

Figure 3:
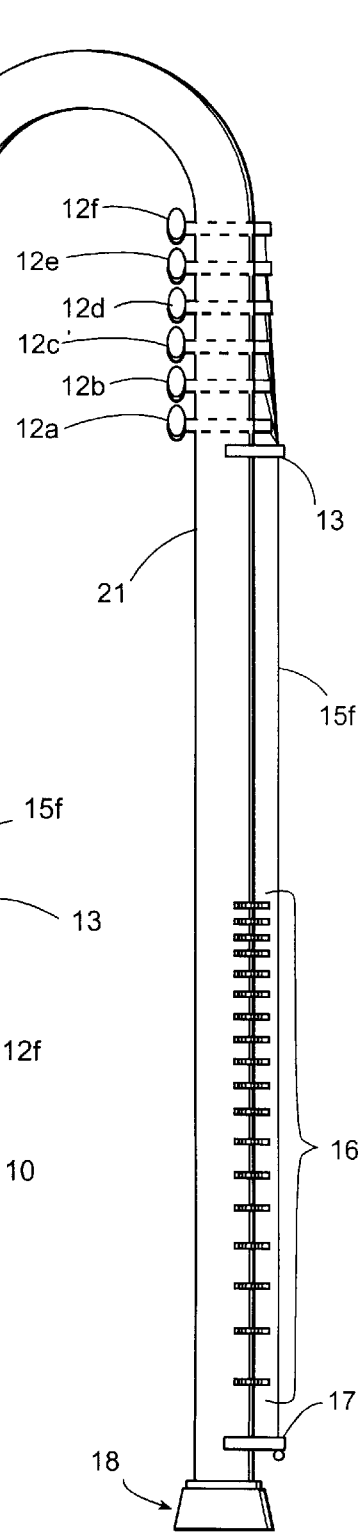
FIG. 3 is a right side view of the first preferred embodiment of the present invention illustrated in FIGS. 1 and 2.

Turning now to FIG. 3, a right side view of the first preferred embodiment of the present invention illustrated in FIGS. 1 and 2 is shown. The special relationship between the strings (only string 15*f* is visible in FIG. 3) and the underlying frets 16 is illustrated. Each individual fret comprising the plurality of frets 16 is rigidly attached to the body portion such that a flat upper surface 61 (FIG. 6) of the fret 16 underlies the strings 15*a–f* and is separated therefrom by a distance. When the cane 10 is used as a musical instrument, the fingers of one hand of a person are employed to depress selected strings to press against a particular fret thereby changing its effective length, tension and vibrational frequency. The fingers of the person's opposing hand are used to strum the strings between the bridge 13 and the frets 16 to force the strings to vibrate.

FIG. 4 is a front view of the first preferred embodiment of the present invention illustrated in FIGS. 1–3. A hole 14 may be cut into the body portion of the cane between the bridge and the nut providing means for sound generated by the overlying vibrating strings to enter and exit the interior chamber of the cane.

FIG. 5 is a rear view of the first preferred embodiment of the present invention illustrated in FIGS. 1–4. The tuning pegs 12*a*–*f* are rotatably mounted on the body portion 21 such that half of the tuning pegs project from one side of the body portion and the remaining tuning pegs project outwardly from the opposing side of the body portion.

A front perspective view of an individual fret comprising the plurality of frets 16 is shown in FIG. 6. The fret 16 has a flat upper string-facing surface 61 and a lower curved surface 62 adapted to conform to the curvature of the body portion of the cane for affixation thereto such as by welding or an adhesive. The bridge 13 is shown in front perspective view in FIG. 7. The bridge 13 includes a plurality of notches 71*a*–*f* dimensioned to accommodate a portion of the strings 15*a*–*f* therewithin and prevent them from sliding laterally across the bridge. A portion 72 of the lower surface of the bridge is contoured to conform to the curvature of the outer surface of the body portion at its point of attachment thereto. The bridge 13 may be either rigidly or slidably mounted on the body portion.

While particular embodiments of the present invention have been illustrated and described, it would be obvious to those skilled in the art that various other changes and modifications can be made without departing from the spirit and scope of the invention. For example, the instrumental portion of the cane 10 may comprise 2–12 strings, and be played in the manner of a bass, a ukelele, a mandolin, a five-string banjo, a violin or virtually any other stringed instrument. Additionally, the cane 10 may be adapted to operate as a flute, a clarinet or the like by cutting a plurality of holes into the body portion and adding a reed or a fipple if desired. Further, the sound emanating from the cane may be amplified by holding the tip portion against a hollow core door or the like while plucking the strings, or the body portion may include an amplifier pickup for electronic amplification of the sound. It is therefore intended to cover in the appended claims all such changes and modifications that are within the scope of this invention.

What I claim is:

1. A musical cane comprising, in combination: (a) a cane operable for providing support for a person and having a handle portion adapted to be gripped by the person's hand, a tip portion and a hollow, elongate body portion therebetween; and (b) a stringed musical instrument affixed to said body portion.

2. The musical cane of claim 1 wherein said musical instrument comprises a plurality of tuning pegs rotatably attached to said body portion, a nut rigidly attached to said body portion, a bridge mounted on said body portion between said tunable pegs and said nut, and a plurality of strings, each string having one end attached to said nut and the opposing end of each string attached to one tuning peg comprising said plurality of tuning pegs.

3. The musical cane of claim 2 further comprising a hole in said hollow, elongate body portion disposed between said bridge and said nut.

4. The musical cane of claim 2 wherein said tip portion has a rubber cap attached thereto.

5. The musical cane of claim 3 wherein said tip portion has a rubber cap attached thereto.

* * * * *